United States Patent [19]

Taira et al.

[11] 4,058,101

[45] Nov. 15, 1977

[54] CONTROL APPARATUS FOR DIESEL ENGINE

[75] Inventors: Kaoru Taira; Teruo Sato; Yoshiya Ishii, all of Toyota; Yukinori Miyata; Katashi Okamoto, both of Kariya, all of Japan

[73] Assignees: Nippondenso Co., Ltd., Kariya; Toyota Jidosha Kogyo Kabushiki Kaisha, Toyota, both of Japan

[21] Appl. No.: 702,131

[22] Filed: July 2, 1976

[30] Foreign Application Priority Data

July 8, 1975 Japan ..... 50-84236

[51] Int. Cl.[2] ..... F02D 1/04; F02D 1/06; F02M 3/00

[52] U.S. Cl. ..... 123/140 MP; 123/140 MC; 123/140 FG; 123/140 J

[58] Field of Search ..... 123/140 MP, 140 MC, 123/140 FG, 140 J, 179 L

[56] References Cited

U.S. PATENT DOCUMENTS

| | | | |
|---|---|---|---|
| 3,664,319 | 5/1972 | Channing | 123/140 MC |

FOREIGN PATENT DOCUMENTS

| | | | |
|---|---|---|---|
| 1,096,148 | 12/1954 | France | 123/140 MP |
| 1,123,161 | 2/1962 | Germany | 123/140 MP |
| 1,113,851 | 9/1961 | Germany | 123/140 MP |
| 532,072 | 1/1941 | United Kingdom | 123/140 MC |

*Primary Examiner*—Ronald H. Lazarus
*Assistant Examiner*—P. S. Lall
*Attorney, Agent, or Firm*—Cushman, Darby & Cushman

[57] ABSTRACT

The present invention discloses an improved control apparatus for a Diesel engine. The control apparatus includes an auxiliary intake air throttle device as well as a conventional main throttle device, which is actuable and throttles intake air only during engine idling and light-load operation in order to reduce the engine noise. The apparatus is further provided with a fuel metering device for ensuring the precise control on fuel metering when the auxiliary intake air throttle device is actuated so that the engine stall may be prevented.

7 Claims, 5 Drawing Figures

CONTROL APPARATUS FOR DIESEL ENGINE

BACKGROUND OF THE INVENTION

The present invention relates to a control apparatus for a Diesel engine, which has a fuel metering device of the pneumatic type for metering fuel to be injected by a fuel injection pump to the engine in response to the flow rate of intake air and an auxiliary intake throttling device actuable only during light load operation of the engine (especially in case of the engine idling) in order to decrease the level of engine noise.

It is well known that the level of Diesel engine noise is considerably higher than the level of noise produced by spark-ignition engines. Especially in case of idling, noise produced by Diesel engines gives annoyance not only to the drivers but also people around the Diesel-engine-mounted vehicles. To overcome this problem, it has been proposed to throttle intake air. In practice at high engine speeds the level of noise produced when intake air is throttled is almost equal to the level of noise produced when intake air is not throttled at all, and only at low speeds there is a difference in level of noise between the both cases. In other words, the method of throttling intake air is effective in reducing the level of noise only at low engine speeds, but is virtually ineffective at high engine speeds. In addition the method of throttling intake air in order to reduce the engine noise gives rise to some problems. That is, when intake air is throttled at high engine speeds or under increased load condition, the engine output drops and the color of emission gases is worsened.

Therefore the device for throttling intake air which is effective in practice must be actuable only during light load operation in which the device is very effective in reducing the engine noise without causing any adverse effect on the engine output.

However when the intake air throttling device of the type described is incorporated with a fuel injection pump or pneumatic governor, the latter does not function properly when the intake air throttling device is actuated because the negative pressure at the throat of an auxiliary venturi which is transmitted to the negative pressure chamber in the pneumatic governor is varied when the intake air is throttled.

SUMMARY OF THE INVENTION

One of the objects of the present invention is therefore to provide a control apparatus capable of throttling intake air only in the low load operation range so as to reduce the engine noise especially in case of engine idling and capable of permitting the normal air intake at high engine speeds with increased load without causing any adverse effects on the engine output and the emission of exhaust gases and yet capable of attaining the precise control on fuel metering even when intake air is throttled.

To the above and other ends, the present invention provides a control apparatus for a Diesel engine, which has an auxiliary throttle valve installed in an air intake manifold for controlling the amount of intake air and brought to the throttling position during low load operation, thereby throttling the amount of intake air as much as possible, but is brought to the fully opened position in the other operation range, said apparatus comprising a fuel metering means including a negative pressure chamber defined therein so that the fuel to be delivered to the engine may be metered in response to the pressure in said negative pressure chamber, an auxiliary venturi means located in the vicinity of said main throttle valve within said air intake manifold such that at least one portion of intake air may flow through said auxiliary venturi means in the whole engine operation range, and a selector valve means operatively coupled to said auxiliary throttle valve for transmitting the negative pressure at the throat of said auxiliary venturi means to said negative pressure chamber of said fuel metering means when said auxiliary throttle valve is brought to said fully opened position or for transmitting the negative pressure in said air intake manifold downstream of said auxiliary throttle valve to said negative pressure chamber of said fuel metering means when said auxiliary throttle valve is brought to said throttling position.

The above and other objects, features and advantages of the present invention will become more apparent from the following description of one preferred embodiment thereof taken in conjunction with the accompanying drawings.

DESCRIPTION OF THE PREFERRED EMBODIMENT

Figure 1:
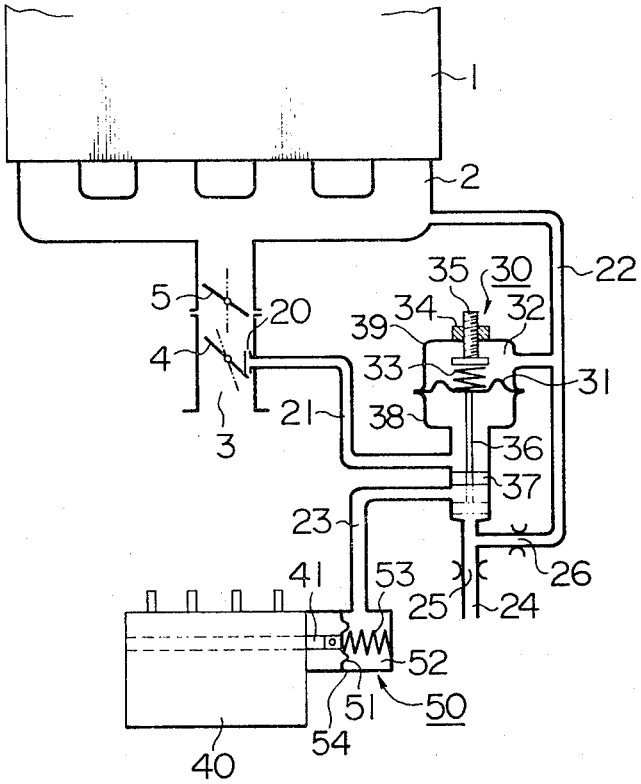
FIG. 1 is a diagrammatic view of one preferred embodiment of the present invention.
Figure 2:
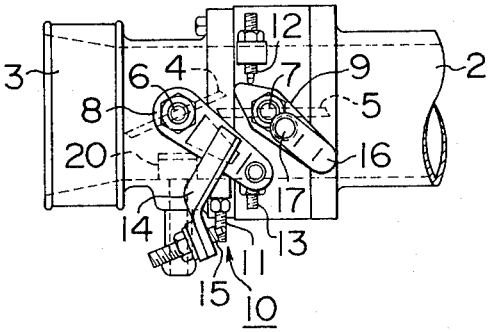
FIGS. 2, 3 and 4 are fragmentary views, on enlarged scale, illustrating the positions of a main and auxiliary valves under different engine operating conditions.

Referring to FIGS. 1 and 2, an intake air tube 3 is connected through an intake manifold 2 to a Diesel engine block 1, having a main throttle valve 4 located therein. An auxiliary throttle valve 5 is located in the intake manifold 2 and positioned at the downstream of the main throttle valve 4. The main and auxiliary throttle valves 4 and 5 are respectively fixed to valve shafts 6 and 7, rotatably carried by the intake tube and manifold, respectively. The valve shafts 6 and 7 are extended through the walls of the intake tube and manifold 3 and 2 and coupled to main and auxiliary adjusting levers 8 and 9, respectively. The main adjusting lever 8 is operatively coupled to an accelerator pedal (not shown) so that the main throttle valve 4 is controlled by the accelerator pedal. Depending upon the opening degree of the main throttle valve 4 the flow rate of air (the speed of the air flow) passing through an auxiliary venturi 20 to be described hereinafter can be changed. The auxiliary throttle valve 5 is controlled by auxiliary throttle valve actuating means 10 in response to the opening degree of the main throttle valve 4. The main throttle valve 4 is biased by a spring (not shown) so as to be normally closed while the auxiliary throttle valve 4 is biased by a spring (not shown) so as to be normally opened. It should be noted that the force of the spring for the auxiliary throttle valve 5 is considerably smaller than that of the spring for the main throttle valve 4.

First, second and third adjusting screws 11, 12 and 13 are attached to the outer walls of the intake manifold and tube 2 and 3.

The first adjusting screw 11 is made into engagement with the main adjusting lever 8 so as to restrict the full open position of the main throttle valve 4 while the second and third adjusting screws 12 and 13 are made into engagement with the auxiliary adjusting lever 9 so as to restrict respectively the fully opened and throttling positions of the auxiliary throttle valve 5.

An arm 14 of the actuating means 10 has its one end securely attached to the middle part of the main adjusting lever 8 substantially at right angles with the axis thereof and the other end portion bent at an angle and provided with a fourth adjusting screw 15. A lever 16 is attached to the auxiliary adjusting lever 9, and a pin 17 is attached to the lever 16 at such a position that it can be engaged with the fourth adjusting screw 15 on the arm 14 when the main adjusting lever 8 is rotated in the direction in which the main throttle valve 4 is closed. The axis of the pin 17 is spaced apart from the axis of the auxiliary throttle valve shaft 7 by a small distance. The auxiliary adjusting lever 9 and the lever 16 attached thereto are so positioned that they will not interfere the rotation of the main adjusting lever 8.

The auxiliary venturi 20 is formed in the intake tube 3 in opposed relation with the main throttle valve 4 which is in the closed position. As with the conventional arrangement the auxiliary venturi 20 is not closed by the main throttle valve 4 in the closed position. That is, the upstream and downstream openings of the venturi 20 are always communicated with each other. The auxiliary venturi 20 is positioned upstream of the auxiliary throttle valve 5 and communicates with one end of a negative pressure transmission hose 21 the other end of which communicates with a selector valve 30.

The selector valve 30 is actuated in response to the negative pressure (intake manifold negative pressure) downstream of the auxiliary throttle valve 5 in the air intake manifold 2, comprising a housing 38 and a cover 39 coupled together the interior of which is divided by a diaphragm 31 into an upper negative pressure chamber 32 to which is transmitted the intake manifold negative pressure through a negative pressure transmission hose 22 and a lower valve chamber. A spring 33 is loaded between the upperside of the diaphragm 31 and the lower end of an adjusting screw 35 screwed into a nut 34 attached to the top wall of the housing so as to bias the diaphragm 31 downwardly. The force of the spring 33 exerted to the diaphragm 31 to oppose the negative pressure acting on the same may be suitably adjusted by the adjusting screw 35. A rod 36 is attached at the upper end thereof to the center of the undersurface of the diaphragm 31, to the lower end thereof being attached a valve element 37 which is slidably fitted in the lower chamber.

The other end of the negative pressure transmission hose 21 is opened into the lower chamber of the selector valve 30. A hose 23 is connected at its one end to a pneumatic governor 50 to be described hereinafter and opened at its other end into the lower chamber of the selector valve 30 in spaced relation downwardly from the opening of the hose 21 by a predetermined distance. The space below the valve element 37 is communicated with the surrounding atmosphere through a hose 24 provided with a variable orifice 25. The hose 22 communicated at its one end with the intake manifold 2 is communicated at its other end with the hose 24 at the upstream of the variable orifice 25. The hose 22 is provided with an orifice 26.

When the valve element 37 is in the position indicated by solid lines in FIG. 1; that is, the intermediate position between the openings of the hoses 21 and 23, the hoses 23 and 24 are intercommunicated, while when the valve element 37 is in the lower position indicated by broken lines in FIG. 1 the hoses 21 and 23 are intercommunicated.

A fuel injection pump 40 for injecting fuel into the combustion chambers in the engine block 1 is of the conventional type having a control rack 41 for controlling the volume of fuel to be injected. The fuel injection pump 40 is operatively coupled to the pneumatic type governor 50.

The governor 50 has a housing 54 the interior of which is divided by a spring loaded diaphragm 51 into two chambers one of which is referred to as a negative pressure chamber 52 and is communicated with the hose 23. A spring 53 is provided so as to oppose the negative pressure acting on the diaphragm 51.

Next the mode of operation will be described. When the accelerator pedal (not shown) is not depressed or in OFF position, the main and auxiliary throttle valves 4 and 5 are in the position shown in FIG. 4. Then the fourth adjusting screw 15 attached to the arm 14 which in turn is fixed to the main adjusting lever 8 is in engagement with the pin 17 of the auxiliary adjusting lever 9, pushing it upward. Consequently the auxiliary adjusting lever 9 is made into engagement with the third adjusting screw 13 so that the auxiliary throttle valve 5 is brought to the closed or throttling position. The third adjusting screw 13 is so adjusted that when the auxiliary throttle valve 5 is in the closed position and when the engine is idling, the volume of intake air is throttled to a lowest possible limit not causing the engine stall.

Figure 5:
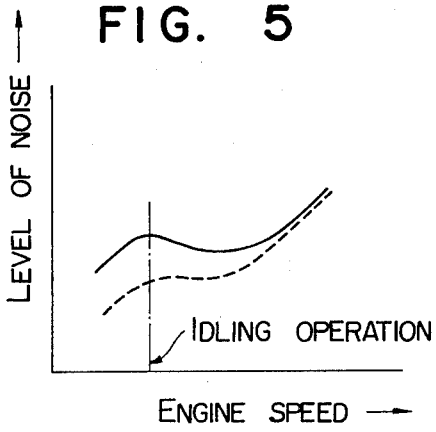
FIG. 5 is a graph illustrating the relation between the level of engine noise and the engine speed.

In FIG. 5 the solid line curve indicates the level of noise when intake air is not throttled while the broken line curve indicates the level of noise when intake air is throttled. It is seen that in case of the engine idling when intake air is throttled by the auxiliary throttle valve, the noise level is considerably decreased. It should be noted that in case of the engine idling, the output is not required so that it is not adversely affected by throttling intake air.

Figure 4:
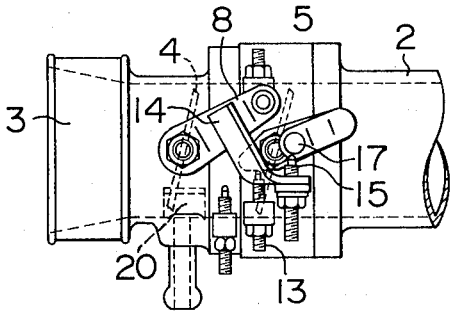

Under the condition shown in FIG. 4, the negative pressure produced at the throat of the auxiliary venturi 20 is not so high as to cause the displacement of the diaphragm 51 of the governor 50 against the spring 53. (Under this condition the pressure in the vicinity of the auxiliary venturi 20 is almost equal to the atmospheric pressure because the auxiliary throttle valve 5 is almost closed). However the intake manifold negative pressure which is almost equal to the absolute vacuum is transmitted through the hose 22 to the negative pressure chamber 32 of the selector valve 30 so that the pressure in the lower chamber causes the diaphragm 31 to be displaced upwardly against the spring 33. Consequently the valve rod 36 and hence the valve element 37 are lifted to the position indicated by the solid lines in FIG. 1 so that the hoses 22 and 23 are intercommunicated and consequently the intake manifold negative pressure is transmitted to the negative pressure chamber 52 of the governor 50. Therefore the fuel may be metered accordingly. The negative pressure transmitted to the negative pressure chamber 52 is adjusted to a suitable level by the variable orifice 25 in the hose 24, and the variable orifice 26 in the hose 22 prevents the flow of atmospheric air into the intake manifold 2 through the hose 22.

Figure 3:
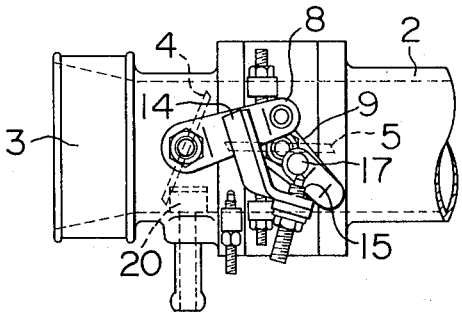

FIG. 3 shows the positions of the main and auxiliary throttle valves 4 and 5 when the accelerator pedal is being shifted to the ON position from the OFF position. When the main throttle valve 4 is rotated through a small angle in the direction in which the throttle valve 4 is opened, the adjusting screw 15 on the arm 14 is moved away from the pin 17. Consequently the biase spring (not shown) causes the auxiliary throttle valve 5 to rotate, following the displacement of the third adjusting screw 15. Since the axes of the auxiliary throttle valve shaft 7 and the pin 17 are spaced apart by a small distance, the small rotation of the main throttle valve 4 and hence the small displacement of the third adjusting screw 15 cause the auxiliary throttle valve 5 to be fully opened so that the intake air throttling by the auxiliary throttle valve 5 is not made and consequently the decrease in engine output is prevented.

FIG. 2 shows the position of the auxiliary throttle valve 5 when the main throttle valve 4 is relatively wide opened. That is, the auxiliary throttle valve 5 is held in the fully opened position while the main throttle valve 4 is controlled by the accelerator pedal in the conventional manner. Therefore the engine output is equal to that produced by the conventional engine in which the auxiliary throttle valve is not provided.

When the main and auxiliary throttle valves 4 and 5 are in the positions shown in FIGS. 2 and 3; that is, when the auxiliary throttle valve 5 is fully opened, the negative pressure in the intake manifold 2 decreases and approaches the atmospheric pressure. Consequently the pressure in the upper chamber 32 of the selector valve 30 cannot cause the diaphragm 31 to be lifted against the spring 33 so that the valve element 37 remains in the position indicated by the broken lines in FIG. 1 and consequently the hoses 21 and 23 are intercommunicated. As a result the negative pressure at the throat of the auxiliary venturi 20 is transmitted into the negative pressure chamber 52 of the governor 50. In these conditions, since the suitable negative pressure is produced by the auxiliary venturi 20, the optimum fuel injection control can be attained as with the case of the prior art.

As described above, the auxiliary throttle valve 5 throttles intake air only in case of idling, thereby reducing the level of the engine noise, but in the other operating range in which the engine noise is not so much reduced by throttling of intake air, the auxiliary throttle valve is held in the fully opened position so that it will not cause the decrease in engine output. Moreover the selector valve 30 ensures the proper function of the governor 50 when the auxiliary throttle valve 5 is in the closed position, throttling the intake air.

In the present embodiment the auxiliary throttle valve 5 has been described as being actuated by mechanical means comprising the arm 14, the adjusting screw 15 and the pin 17, but alternatively a microswitch may be used such that it may be closed only when the main adjusting lever 8 is in the idling position (that is, when the accelerator pedal is in OFF position), thereby energizing a solenoid to close the auxiliary throttle valve 5. Instead of the diaphragm type selector valve 30, a solenoid control valve which may be controlled by the microswitch may be used. The engine operation range in which the auxiliary throttle valve 5 is held in the closed or throttling position should be determined in due consideration of circumstances desired to reduce the level of the engine noise and condition of the engine output, and is not limited only in case of the engine idling. That is, the auxiliary throttle valve 5 may be generally brought into the closed or throttling position during idling and light load operation. In the broader sense, the intake tube 3 should be considered as being a part of the intake manifold 2 and consequently the main throttle valve 4 should be considered as being installed within the intake manifold 2.

As described above, according to the present invention the noise of the Diesel engines may be considerably reduced without the engine output being adversely affected. In addition, the pneumatic governor may ensure the precise control of fuel metering.

What is claimed is

1. A control apparatus for a Diesel engine comprising:

a fuel injection pump for injecting fuel to an engine, said fuel injection pump having a control rack for controlling the amount of the fuel injected to the engine;

a main throttle valve installed in an intake manifold of the engine for controlling the speed of intake air flow;

venturi means disposed in the intake manifold of the engine for permitting intake air to flow therethrough with the speed controlled by said main throttle valve;

an auxiliary throttle valve installed in the intake manifold for throttling intake air in its throttling position;

actuating means connected to said auxiliary throttle valve for bringing the same into said throttling position only during low load operation of the engine;

fuel metering means for controlling said control rack and hence the amount of fuel injected to the engine, said fuel metering means having a housing and a deflectable member coupled together for forming therebetween a pressure chamber to be supplied with the negative pressure, said deflectable member being connected to said control rack to control said control rack in response to the negative pressure in said pressure chamber; and selector valve means operatively connected to said auxiliary throttle valve for transmitting the negative pressure in said venturi means to said pressure chamber of said fuel metering means when said auxiliary throttle valve is opened and for transmitting the negative pressure in said intake manifold downstream of said auxiliary throttle valve to said pressure chamber of said fuel metering means when said auxiliary throttle valve is in its throttling position.

2. A control apparatus as set forth in claim 1, wherein said selector valve means comprises:

a housing and a cover coupled together, a diaphragm interposed between said housing and said cover for forming a negative pressure chamber with said cover and a valve chamber with said housing;

a spring for normally biasing said diaphragm toward said valve chamber;

a valve element connected to said diaphragm for slidable movement in said valve chamber;

said negative pressure chamber being communicated with said air intake manifold downstream of said auxiliary throttle valve;

a first port opened into said valve chamber and communicating with said venturi means;

a second port opened into said valve chamber and communicating with said intake manifold downstream of said auxiliary throttle valve;

a third port opened into said valve chamber and communicating with said pressure chamber of said fuel metering means; and said valve element being selectively displaced between a first position and a second position in response to the negative pressure in said negative pressure chamber of said selector valve means, whereby said second and third ports intercommunicate when said valve element is in said first position while said first and third ports intercommunicate when said valve element is in said second position.

3. A control apparatus as set forth in claim 2, wherein:

an orifice is placed in a passage communicating between said second port and said intake manifold; and a passage with one end thereof opened into the surrounding atmosphere has its the other opening end connected to said first mentioned passage between said first mentioned orifice and said second port, said second mentioned passage including an orifice placed therein.

4. A control apparatus as set forth in claim 1, wherein said auxiliary throttle valve is operatively coupled to said main throttle valve.

5. A control apparatus as set forth in claim 4, further comprising:

a lever fixed to the shaft of said main throttle valve for rotation in unison with said main throttle valve;

a lever fixed to the shaft of said auxiliary throttle valve for rotation in unison with said auxiliary throttle valve;

a spring for normally biasing said auxiliary throttle valve to the fully opened position; and means for transmitting the rotation of said first mentioned lever of said main throttle valve to said second mentioned lever of said auxiliary throttle valve so that said auxiliary throttle valve may be brought to the throttling position against said spring only when said main throttling valve is in the low load operation position.

6. A control apparatus as set forth in claim 4, further comprising:

a switch which is closed when said main throttle valve is in the low load operation position; and a solenoid operated actuator means for controlling said auxiliary throttle valve such that said auxiliary throttle valve is brought to the throttling position when said switch is closed while said auxiliary throttle valve is brought to the fully opened position when said switch is opened.

7. A control apparatus as set forth in claim 6, wherein said selector valve means is a solenoid operated valve actuable by said switch.

* * * * *